US011225814B2

(12) United States Patent
Han

(10) Patent No.: US 11,225,814 B2
(45) Date of Patent: Jan. 18, 2022

(54) DOOR LATCH FOR VEHICLE

(71) Applicant: DAEDONG DOOR INCORPORATED, Gyeonggi-do (KR)

(72) Inventor: Sung Hee Han, Incheon (KR)

(73) Assignee: Daedong Door Incorporated, Gyeonggi-do (KR)

( * ) Notice: Subject to any disclaimer, the term of this patent is extended or adjusted under 35 U.S.C. 154(b) by 594 days.

(21) Appl. No.: 16/181,090

(22) Filed: Nov. 5, 2018

(65) Prior Publication Data

US 2019/0136586 A1 May 9, 2019

(30) Foreign Application Priority Data

Nov. 6, 2017 (KR) ..... 10-2017-0146504

(51) Int. Cl.

| | |
|---|---|
| ***E05B 77/32*** | (2014.01) |
| ***E05B 79/20*** | (2014.01) |
| ***E05B 79/10*** | (2014.01) |
| ***E05B 77/30*** | (2014.01) |
| ***E05B 77/22*** | (2014.01) |

(52) U.S. Cl.

CPC ..... *E05B 77/32* (2013.01); *E05B 77/22* (2013.01); *E05B 77/30* (2013.01); *E05B 79/10* (2013.01); *E05B 79/20* (2013.01); *E05Y 2900/531* (2013.01)

(58) Field of Classification Search

CPC ..... E05B 77/32; E05B 79/20; E05B 77/22; E05B 79/10; E05B 77/30; E05B 2015/0403

See application file for complete search history.

(56) References Cited

U.S. PATENT DOCUMENTS 5,803,515 A * 9/1998 Arabia, Jr. ..... E05B 85/243 292/201
5,921,595 A * 7/1999 Brackmann ..... E05B 83/36 292/216
6,148,651 A * 11/2000 Roncin ..... E05B 77/265 292/201

(Continued)

FOREIGN PATENT DOCUMENTS

EP 2369103 A2 * 9/2011 ..... E05B 77/30
KR 100828440 B1 * 5/2008

(Continued)

*Primary Examiner* — Kristina R Fulton
*Assistant Examiner* — Emily G. Brown
(74) *Attorney, Agent, or Firm* — Adsero IP

(57) ABSTRACT

Disclosed is a vehicle door checker that includes: an open lever configured to rotate a pawl in an open direction; a handle open lever having a link pin insertion groove; an inner handle lever connected to an inner handle cable and including a first contact end and a second contact end configured to come into contact with the handle open lever while being rotated in the open direction; an inner link lever configured to come into contact with the first contact end when the inner handle lever is rotated in the open direction; an inner lock lever configured to share a rotation axis with the inner link lever; an elastic member fastened between the inner link lever and the inner lock lever; and a link including a link pin interlocked with rotation of the inner lock lever in an unlocking direction.

5 Claims, 3 Drawing Sheets

(56) References Cited

U.S. PATENT DOCUMENTS

| | | | | |
|---|---|---|---|---|
| 6,189,940 | B1 * | 2/2001 | Hayakawa | E05B 81/06 292/201 |
| 6,406,073 | B1 * | 6/2002 | Watanabe | E05B 77/265 292/216 |
| 6,592,157 | B1 * | 7/2003 | Spurr | E05B 85/01 292/201 |
| 10,370,879 | B2 * | 8/2019 | Tomaszewski | E05B 81/34 |

FOREIGN PATENT DOCUMENTS

| | | | | |
|---|---|---|---|---|
| KR | 100841552 | B1 * | 6/2008 | |
| KR | 101587816 | B1 * | 1/2016 | |
| WO | WO-2013110149 | A1 * | 8/2013 | E05B 77/30 |

* cited by examiner

DOOR LATCH FOR VEHICLE

CROSS-REFERENCE TO RELATED APPLICATION

This application claims priority to and the benefit of Korean Patent Application No. 10-2017-0146504 filed on Nov. 6, 2017, the disclosure of which is incorporated herein by reference in its entirety.

BACKGROUND OF THE INVENTION

1. Field of the Invention

The present disclosure relates to a vehicle door latch that controls opening and closing of a vehicle door.

2. Description of the Prior Art

A vehicle door is usually provided with a door latch for controlling opening and closing operations. In a door-closed state, the door latch is engaged with a striker provided in the vehicle body so as to maintain and fix the door-closed state while the door latch is released from the striker according to a user's manipulation of a handle, thereby allowing the door to be opened.

The door latch has various additional functions, which are added to a basic function of controlling the opening/closing of the door as described above. For example, most door latches include a door-locking function that restricts door from being opened by handle operation. When a door-locking function is activated, the door latch is capable of remaining engaged with the striker despite a user's handle operation, thereby preventing the door from being opened. In this case, the user deactivates the door locking and pulls the handle so as to open the door.

In addition to the door-locking function, various functions are added to the door latches for safety and ease of use. For example, previously developed functions include a child lock function to limit door opening caused through the inner handle for the safety of infants and young children, a dead-lock function to limit the deactivation of locking function in order to prevent unauthorized entry into the vehicle interior, and an override function to release a locked state by only the operation of an inner handle in the door-locked state for the sake of user's convenience.

In particular, the override function has been employed in many vehicles due to the recent trend of emphasizing user convenience. Such an override function requires the addition of a number of lever components or a complicated link structure to an existing door latch (i.e., a door latch which does not include the override function), which causes a problem of increasing manufacturing costs or deteriorating assemblability. Further, in the case where the override function is added, the lever operation according to the operation of the inner handle and the lever operation by the other operation button collide with each other, and thus the damage to or malfunction of the lever components may occur frequently. Typically, when the user (occupant) operates the inner handle and the respective lever components of the door latch cooperate with each other to release the lock state, and at the same time another user (driver) releases the lock state via a door lock button, the actions of the lever components by the two operations are interlocked with each other, resulting in a kind of jam, which may cause the door latch not to operate properly or damage to the lever components and the like.

SUMMARY OF THE INVENTION

Embodiments of the present disclosure aim to provide a vehicle door latch including an override function, in which the vehicle door latch is capable of effectively preventing damage or malfunction of the lever components even though the vehicle is structurally simplified by reducing the number of components.

According to an aspect of the present disclosure, a vehicle door checker may be provided that includes: an open lever configured to rotate a pawl in an open direction; a handle open lever having a link pin insertion groove; an inner handle lever connected to an inner handle cable to be rotated in an open direction in response to operation of an inner handle, and including a first contact end and a second contact end configured to come into contact with the handle open lever while being rotated in the open direction so as to rotate the handle open lever in the open direction; an inner link lever configured to come into contact with the first contact end when the inner handle lever is rotated in the open direction so as to be interlockingly rotated in an unlocking direction; an inner lock lever configured to share a fifth rotation axis with the inner link lever; an elastic member fastened between the inner link lever and the inner lock lever so as to transmit a rotational force of the inner link lever in the unlocking direction to the inner lock lever; and a link including a link pin interlocked with rotation of the inner lock lever in the unlocking direction so as to be fastened to the link pin insertion groove.

The vehicle door latch according to embodiments of the present disclosure has a first contact end and a second contact end, which are formed on the inner handle lever, so that the door lock state can be deactivated (unlocked) by interlocking with the first contact end and the door can be opened by interlocking with the second contact end. The inner handle lever is capable of reducing the number of lever components for implementing the override function and realizing the structure simplification by implementing the above two interlocking operations with a single lever component.

The vehicle door latch according to embodiments of the present disclosure is configured such that the first contact end first comes into contact with the inner link lever and the second contact end sequentially comes into contact the handle open lever, so that the deactivation (unlocking) of the door locking state and the opening operation of the door can be sequentially performed. Therefore, despite the structural simplification, it is possible to minimize the interference or malfunction of the lever components when the override function is executed.

The vehicle door latch of the present embodiment includes the inner link lever and the torsion spring and is configured such that the rotational force of the inner handle lever is transmitted to the inner lock lever through the inner link lever and the torsion spring. That is, the inner lock lever is not directly interlocked with the inner handle lever or the inner link lever, but receives a rotational force through a predetermined buffer means called a torsion spring. Therefore, even when the operation of the other operation button is simultaneously performed with the operation of the inner handle, or even if the lever components are not disposed at correct positions for a certain reason, the lever components can be prevented from being damaged through the buffering action of the torsion spring.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION OF THE EXEMPLARY EMBODIMENTS

Hereinafter, embodiments of the present disclosure will be described with reference to the accompanying drawings. However, it should be understood that the following embodiments are provided in order to help understand the present disclosure, and the scope of the present disclosure is not limited to the following embodiments. The following embodiments are provided to explain the present disclosure more fully to a person ordinarily skilled in the art. A detailed description of a known configuration will be omitted when it is determined that the description makes the technical gist of the present disclosure rather unclear.

Figure 1:
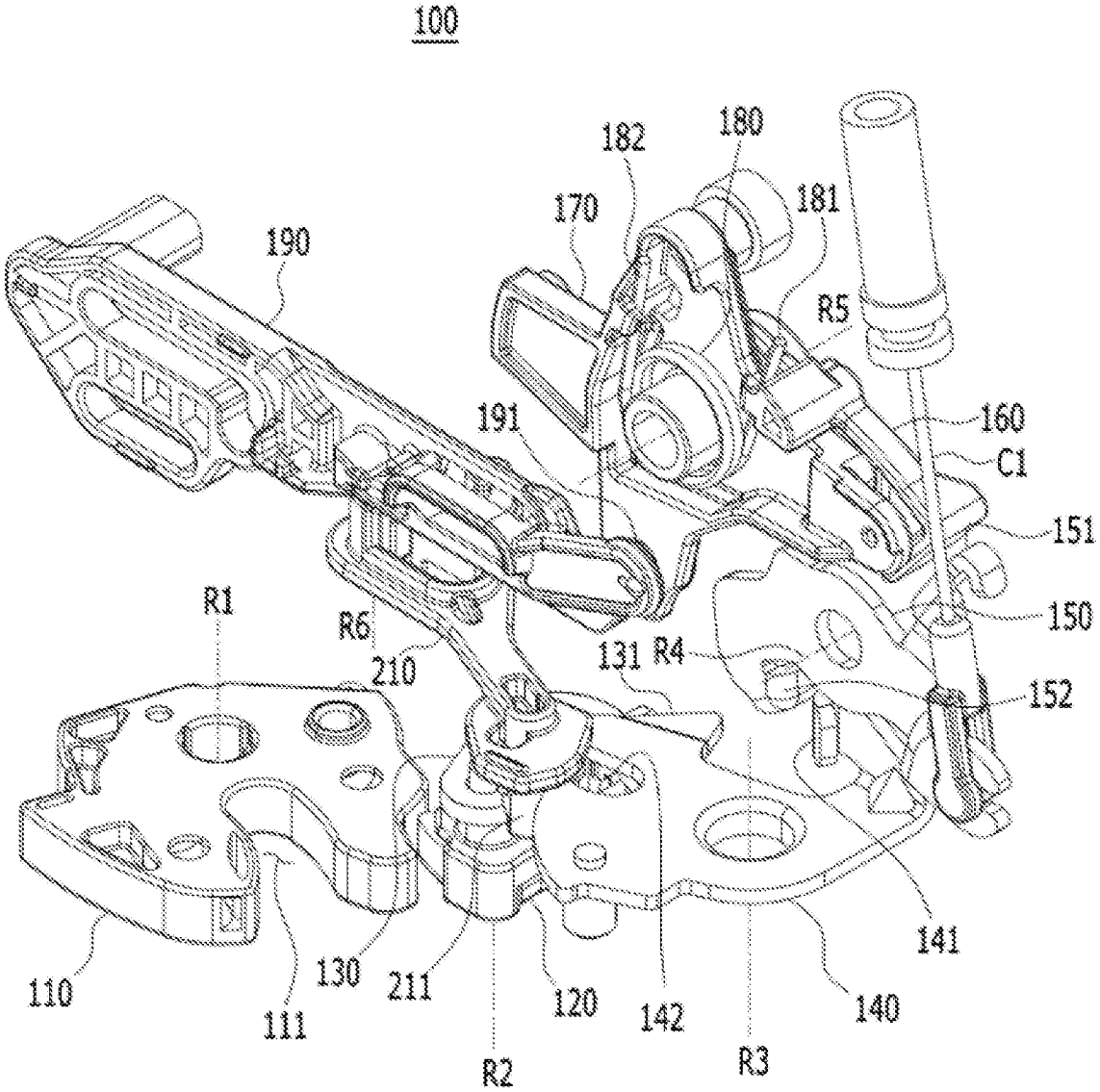
FIG. 1 is a perspective view schematically illustrating a vehicle door latch according to an embodiment of the present disclosure.
Figure 2:
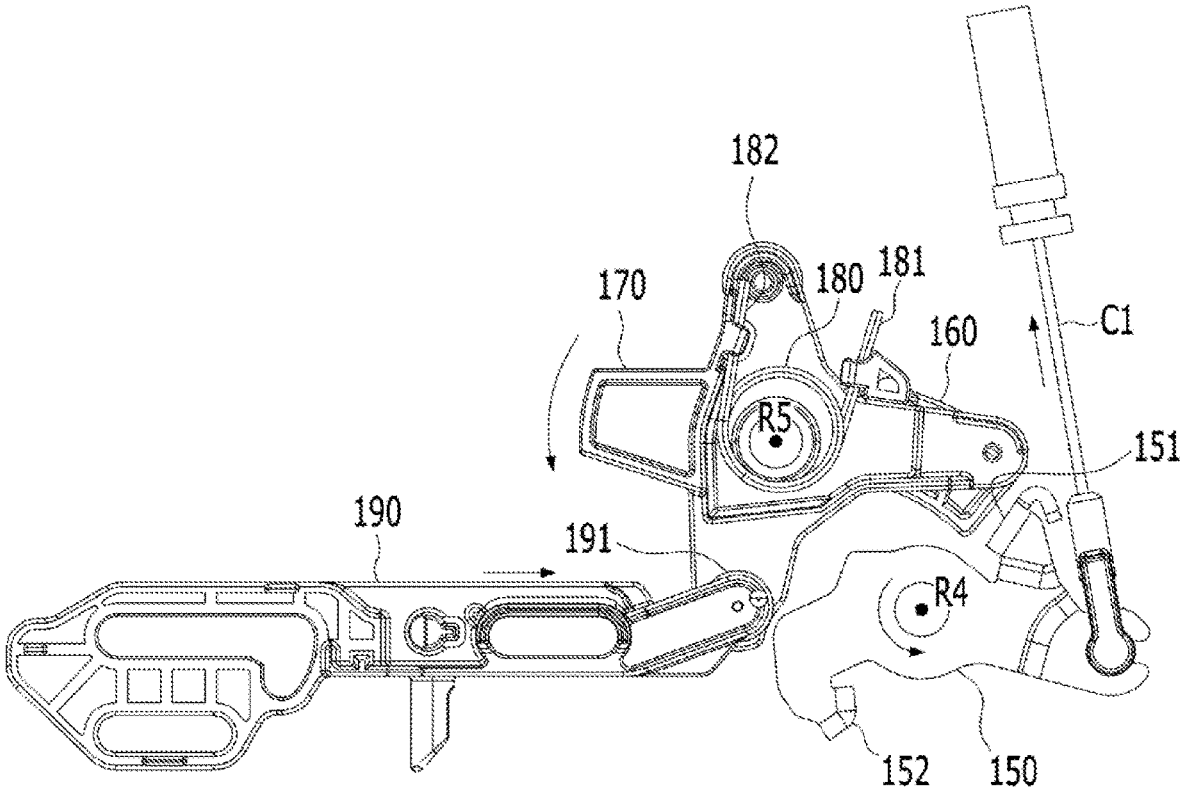
FIG. 2 is a schematic view of an inner handle lever, an inner link lever, an inner lock lever, and a relay lever illustrated in FIG. 1, which are viewed from the front side.
Figure 3:
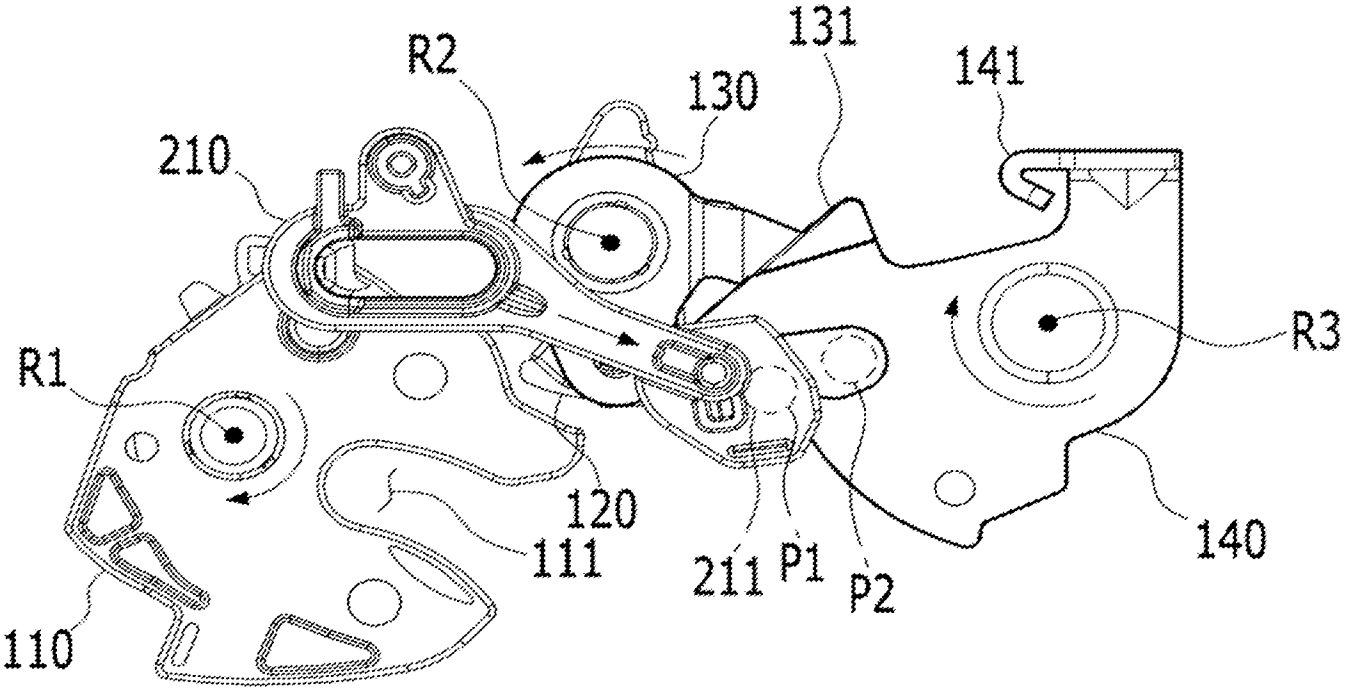
FIG. 3 is a schematic view of a handle open lever, a link, an open lever, a pawl, and a catch illustrated in FIG. 1, which are viewed from above.

FIG. 1 is a perspective view schematically illustrating a vehicle door latch 100 according to an embodiment of the present disclosure. FIG. 2 is a schematic view of an inner handle lever 150, an inner link lever 160, an inner lock lever 170, and a relay lever 190 illustrated in FIG. 1, which are viewed from the front side. FIG. 3 is a schematic view of a handle open lever 140, a link 210, an open lever 130, a pawl 120, and a catch 110 illustrated in FIG. 1, which are viewed from above.

It is noted that, for the convenience of explanation, FIGS. 1 to 3 illustrate only the main configuration related to the present disclosure, and the remaining portions are omitted from the drawings. It is also noted that FIGS. 1 to 3 illustrate an arrangement state or the like of respective components based on the case where the door lock function is activated (locked) in the door-closed state.

Referring to FIGS. 1 to 3, a vehicle door latch (hereinafter, referred to as a "door latch 100") of the present embodiment may include a catch 110.

The catch 110 may be provided to be rotatable about a first rotation axis R1. The catch 110 may be engaged with a striker (not illustrated) installed at one side of the vehicle body so as to restrain the door in the closed state. An engagement groove 111 to which the striker is engaged may be provided at one side of the catch 110.

When the door is closed, the catch 110 collides with the striker. Due to an impact caused by the collision, the catch 110 is capable of being rotated about the first rotation axis R1, and the striker is engaged with the engagement groove 111, which causes the door to be restrained in the closed state. FIGS. 1 to 3 illustrated a state in which the striker is engaged with the engagement groove 111 and the door is restrained and held in the closed state.

The catch 110 may be rotated clockwise about the first rotation axis R1 in the illustrated state and may be switched to a state in which the catch 110 is capable of being disengaged from the striker. The rotation direction of the catch 110 (the clockwise direction in the drawings) is referred to as an open direction. According to this, the catch 110 is capable of being rotated in the open direction (the clockwise direction in the drawings) so as to be switched to the state in which the catch 110 is releasable from the striker. In this state, the door can be opened.

The door latch 100 of the present embodiment may include a pawl 120.

The pawl 120 may be provided to be rotatable about a second rotation axis R2. The pawl 120 may be engaged with one side of the catch 110 in the door-closed state so as to restrict the rotation of the catch 110 in the open direction (the clockwise direction in the drawings). That is, in the door-closed state, the catch 110 may be rotationally restrained by the pawl 120, whereby the door may be restrained and held in a closed state.

In the illustrated state, the pawl 120 may be disengaged from the catch 110 by being rotated counterclockwise about the second rotation axis R2. In such a case, the catch 110 is released from the restraint so that the door can be opened. Therefore, the rotation direction of the pawl 120 as described above (the counterclockwise direction in the drawings) will be referred to as an open direction. Accordingly, the pawl 120 is rotated in the open direction (the counterclockwise direction in the drawings), so that the engagement with the catch 110 can be released. When the engagement of the catch 110 is released, the catch 110 is rotated and returned in the open direction (the clockwise direction in the drawings) by a resilient means so as to be disengaged from the striker, so that the door can be opened.

The door latch 100 of the present embodiment may include an open lever 130.

The open lever 130 may be provided to be rotatable while sharing the second rotation axis R2 with the pawl 120. The open lever 130 may be fastened to the pawl 120 so as to interlockingly rotate the pawl 120 in the open direction (the counterclockwise direction in the drawings) in the door-closed state. That is, when the open lever 130 is rotated in the counterclockwise direction in the illustrated state, the pawl 120 is rotated in the open direction (the counterclockwise direction in the drawings) to be interlocked therewith. The counterclockwise rotation of the open lever 130 as described above corresponds to the open direction of the pawl 120 (the counterclockwise direction in the drawings). Thus, the counterclockwise rotation will be referred to as open direction rotation.

The open lever 130 is configured to interlockingly rotate the pawl 120 in the open direction (the counterclockwise direction) to be interlocked with the rotation of the handle open lever 140, which will be described later, and may be provided with a link pin interlocking portion 131 that receives the rotational operation force of the handle open lever 140 through the link pin 211. The link pin interlocking portion 131 may be spaced apart from the second rotation axis R2 by a predetermined distance so as to be adjacent to the link pin insertion groove 142 of the handle opening lever 140 in the door-closed state.

The door latch 100 of the present embodiment may include the handle open lever 140.

The handle open lever 140 may be provided to be rotatable about the third rotation axis R3. When rotated clockwise in the state illustrated in the drawing according to the operation of the inner handle (not illustrated), the handle open lever 140 is capable of interlockingly rotating the open lever 130 in the open direction (the counterclockwise direction in the drawings). The counterclockwise rotation of the handle open lever 140 corresponds to the rotation of the open lever 130 in the open direction (the clockwise direction in the drawings). Thus, the counterclockwise rotation will be referred to as open direction rotation.

However, as shown in the drawings, in the state in which the door lock is activated (locked), the handle open lever 140 is not interlocked with the open lever 130. The open lever 130 is disposed below the handle open lever 140 such that the handle open lever 140 will not affect the open lever 130 even if the handle open lever 140 is rotated. Therefore, even if the handle open lever 140 is rotated by itself in this state, the door is not opened and is in the locked state. For example, an out handle (not illustrated) is connected to the handle open lever 140 through a predetermined link or cable, and thus the door is not opened even if the handle open lever 140 is rotated by the operation of the out handle.

In this case, the rotational interlocking between the handle open lever 140 and the open lever 130 may be performed by the link pin 211 to be described later. That is, depending on the position of the link pin 211, the interlocking between the handle open lever 140 and the open lever 130 is activated (the lock state is deactivated (unlocked)) or deactivated (the lock state is activated (locked)). For the purpose of interlocking with the link pin 211, the handle opening lever 140 may be provided with a link pin insertion groove 142 into which the link pin 211 may be inserted and fastened. The link pin insertion groove 142 may be formed by recessing one side of the handle open lever 140 at a position corresponding to the link pin 211.

The handle opening lever 140 is capable of receiving the operation force of the inner handle by the inner handle lever 150 to be described later. To this end, a handle open lever contact end 141 may be provided at one side of the handle open lever 140. The handle open lever contact end 141 is spaced apart from the third rotation axis R3 by a predetermined distance to be adjacent to the second contact end 152 of the inner handle lever 150 to be described later in the door-closed state as illustrated.

The door latch 100 of the present embodiment may include the inner handle lever 150.

The inner handle lever 150 may be provided to be rotatable about the third rotation axis R4. An inner handle cable C1 may be provided to be connected to the inner handle lever 150. The inner handle cable C1 is capable of transmitting the operation force of the inner handle to the inner handle lever 150. Thus, the inner handle lever 150 is capable of being rotated about the fourth rotation axis R4. More specifically, when the inner handle cable C1 is pulled by the operation of the inner handle in the state illustrated in the drawings, the inner handle lever 150 is rotated counterclockwise about the fourth rotation axis R4. The counterclockwise rotation of the inner handle lever 150 causes the opening operation of the door as will be described later. Thus, the counterclockwise rotation will be referred to as open direction rotation. According to this, the inner handle lever 150 is capable of being rotated in the open direction (the counterclockwise direction in the drawings) as the inner handle cable C1 is pulled.

The inner handle lever 150 is capable of transmitting the operation force of the inner handle to the handle open lever 140 described above and the inner link lever 160 to be described below. In other words, the inner handle lever 150 is rotated in the open direction (the counterclockwise direction in the drawings) in the door-closed state so as to interlockingly rotate the handle open lever 140 and the inner link lever 160.

In order to perform the interlocking rotation described above, a second contact end 152 may be provided on one side of the inner handle lever 150. The second contact end 152 corresponds to the handle open lever contact end 141 formed on the handle open lever 140 and the inner handle lever 150 is rotated about the fourth rotation axis R4 in the open direction (the clockwise direction), it comes into contact with the handle open lever contact end 141 and rotates the handle open lever 140. Thereby, the handle open lever 140 can be rotated in the open direction (the clockwise direction in the drawings) about the third rotation axis R3.

A first contact end 151 may be provided on the other side of the inner handle lever 150. The first contact end 151 may be spaced apart from the second contact stage 152 by a predetermined distance in the circumferential direction about the fourth rotation axis R4. The first contact end 151 is configured to interlockingly rotate the inner link lever 160 to be described later. When rotated in the open direction (the counterclockwise direction in the drawings) about the fourth rotation axis R4 in the door-closed state, the inner handle lever 150 comes into contact with one side of the inner link lever 160, thereby applying a rotational operation force to the inner link lever 160.

The door latch 100 of the present embodiment may include an inner link lever 160.

The inner link lever 160 may be provided to be rotatable around the fifth rotation axis R5. The inner link lever 160 is configured to transmit the rotational force of the inner handle lever 150 to an inner lock lever 170 to be described later. One side of the inner link lever 160 may be configured to be capable of coming into contact with the first contact end 151 of the inner handle lever 150. In the door-closed state as illustrated, when the inner handle lever 150 is rotated in the open direction (the counterclockwise direction in the drawings), the first contact end 151 comes into contact with the inner link lever 160, so that the inner link lever 160 can be rotated counterclockwise about the fifth rotation axis R5. Since the counterclockwise rotation of the inner link lever 160 finally deactivates (unlocks) the lock state, the counterclockwise rotation will be referred to as unlocking direction rotation. According to this, the inner link lever 160 is capable of being interlocked with the open direction (counterclockwise in the drawings) rotation of the inner handle lever 150 so as to be rotated in the unlocking direction (the counterclockwise direction in the drawings).

The door latch 100 of the present embodiment may include an inner lock lever 170.

The inner lock lever 170 may be provided to share the rotation axis with the inner link lever 160 and to be rotatable about the fifth rotation axis R5. The inner lock lever 170 may be interlocked with the rotation of the inner link lever 160 by an elastic member 180 to be described later. That is, the inner lock lever 170 receives the rotational force of the inner link lever 160 in the unlocking direction (the counterclockwise direction in the drawings) through the elastic member 180, and is capable of rotating counterclockwise about the fifth rotational axis R5 by being interlocked therewith. Similar to the inner link lever 160 described above, the counterclockwise rotation of the inner lock lever 170 will be referred to as unlocking direction rotation. According to this, the inner lock lever 170 is capable of being rotated in the unlocking direction (the counterclockwise direction in the drawings) by being interlocked with the unlocking direction (the counterclockwise direction) rotation of the inner link lever 160 (counterclockwise direction in the figure).

The door latch 100 of the present embodiment may include an elastic member 180.

The elastic member 180 is capable of interlockingly rotating the inner link lever 160 and the inner lock lever 170. Specifically, the elastic member 180 is capable of transmitting the rotational force of the inner link lever 160 in the unlocking direction (the counterclockwise direction in the drawings) to the inner lock lever 170 so as to rotate the inner lock lever 170 in the unlocking direction (the counterclockwise direction in the drawings).

Preferably, the elastic member 180 may be constituted with a torsion spring 180. In this case, a first end portion 181 of the torsion spring 180 may be fastened to the inner link lever 160, and a second end portion 182 of the opposite side may be fastened to the inner lock lever 170.

The door latch 100 of the present embodiment may include a relay lever 190.

One end 191 of the relay lever 190 may be fastened to the inner lock lever 170 so as to be moved back and forth in the longitudinal direction in accordance with the rotation of the inner lock lever 170. That is, when the inner lock lever 170 is rotated in the unlocking direction (the counterclockwise direction in the drawings) in the state illustrated in the drawings, the relay lever 190, the one end 191 of which is fastened to the inner lock lever 170, may be moved back (rightwards in the drawings). The backward (rightward in the drawings) movement of the relay lever 190 will be referred to as unlocking direction movement. According to this, when the inner lock lever 170 is rotated in the unlocking direction (the counterclockwise direction in the drawings), the relay lever 190 may be moved in the unlocking direction (rightward in the figure).

Although not illustrated, the relay lever 190 may be guided in the forward and backward movement as described above through a predetermined support structure.

The door latch 100 of the present embodiment may include a link 210.

One end of the link 210 may be fastened to the relay lever 190 through the sixth rotation axis R6 so as to be interlocked with the movement of the relay lever 190. This will be discussed below in connection with a link pin 211.

The link 210 may include a link pin 211 at the other end. The link pin 211 corresponds to the link pin insertion groove 142 formed in the handle open lever 140 and may be inserted into and fastened to the link pin insertion groove 142 according to the movement of the relay lever 190. That is, when the relay lever 190 is moved in the unlocking direction (rightward in the drawings) in the illustrated door-locked state, the link 210, one end of which is fastened to the relay lever 190, is displaced to be interlocked therewith such that the link pin 211 is inserted into and fastened to the link pin insertion groove 142.

In addition, the link pin 211 may extend vertically by a predetermined length to as to come into contact with the link pin interlocking portion 131 on the lower side of the link pin insertion groove 142.

The link pin 211 may activate (lock) or deactivate (unlock) the door lock state.

That is, when the link pin 211 is disengaged from the link pin insertion groove 142 as illustrated in the drawings, the open lever 130 is not interlocked with the handle open lever 140. Therefore, even if the handle open lever 140 is rotated in the open direction (the clockwise direction in the drawings), the restraint of the catch 110 by the pawl 120 is not released and the door is not opened. That is, the door lock state is activated (locked). Therefore, the position of the link pin 211, which is disengaged from the link pin insertion groove 142 as illustrated, will be referred to as a lock position P1.

When the link 210 is interlocked with the unlocking direction (rightward in the drawings) movement of the relay lever 190 such that the link pin 211 is inserted into and fastened to the link pin insertion groove 142, the open lever 130 can be interlocked with the handle open lever 140. That is, when the handle open lever 140 is rotated in the open direction (the clockwise direction in the drawings), the link pin 211 fastened to the link pin insertion groove 142 is rotated (in the counterclockwise direction in the drawings) about the sixth rotation axis R6 so as to push the link pin interlocking portion 131, whereby the open lever 130 is rotated in the open direction (the counterclockwise direction in the drawings) about the second rotation axis R2. Thus, when the handle open lever 140 is rotated in the open direction (the clockwise direction in the drawings), the open lever 130 is rotated in the open direction (the counterclockwise direction in the drawings) by being interlocked therewith and the pawl 120 is disengaged from the catch 110, so that the door can be opened. That is, the door lock state is deactivated (unlocked). Therefore, the position of the link pin 211 inserted into and fastened to the link pin insertion groove 142 will be referred to as an unlock position P2.

In the door latch 100, the first to third rotation axes R1, R2, and R3 and the fourth to fifth rotary axes R4 and R5 may be disposed to be substantially orthogonal to each other. In other words, the catch 110, the pawl 120, the open lever 130, and the handle open lever 140 may be disposed on a first plane, and the inner handle lever 150, the inner link lever 160, the lever 170, and the relay lever 190 may be disposed on a second plane, which is substantially orthogonal to the first plane. Through this, respective components can be more compactly arranged inside the door latch 100.

The operation of the door latch 100 will be described below.

FIGS. 1 to 3 illustrate the case where the locking function is activated (locked) in the door-closed state.

When the user operates the inner handle in the above state, the inner handle cable C1 is pulled and the inner handle lever 150 is rotated in the open direction (the counterclockwise in the drawings). When the inner handle lever 150 is rotated, the first contact end 151 first comes into contact with the inner link lever 160, whereby the inner link lever 160 is rotated in the unlocking direction (the counterclockwise direction in the drawings). When the inner link lever 160 is rotated, the rotational force is transmitted to the inner lock lever 170 by the torsion spring 180 such that the inner lock lever 170 is rotated in the unlocking direction (the counterclockwise direction in the drawings), whereby the relay lever 190 is moved back in the unlocking direction (rightward in the drawings). When the relay lever 190 is moved, the link pin 211 is inserted into the link pin insertion groove 142 to move to the unlock position P2, and the door lock state is deactivated (unlocked). That is, the door lock is unlocked.

On the other hand, when the inner handle lever 150 is rotated, the second contact end 152 is capable of being brought into contact with the handle open lever 140. At this time, the contact of the second contact end 152 may be formed so as to be sequentially generated following the contact of the first contact end 151. That is, as the inner handle lever 150 is rotated, the first contact end 151 first comes into contact with the inner link lever 160, and then the second contact end 152 comes into contact with the handle open lever 140. This is to first deactivate (unlock) the door lock state and to allow the door-open operation to be interlocked with the second contact end 152. This sequential contact may be easily realized by adjusting the positions of the first and second contact ends 151 and 152.

When the second contact end 152 comes into contact with the handle open lever 140, the handle open lever 140 is rotated in the open direction (the clockwise direction in the drawings). At this time, since the link pin 211 is disposed at the unlock position P2 by the operation interlocked with the first contact end 151 described above, the rotation of the handle open lever 140 is capable of being transmitted to the open lever 130 through the link pin 211. That is, the open lever 130 is capable of being interlocked with the handle open lever 140 so as to be rotated in the open direction (the counterclockwise direction in the drawings). When the open lever 130 is rotated, the pawl 120 rotates therewith and is disengaged from the catch 110, and the catch 110 is released from restraint in rotation to be in the state of being disengaged from the striker. That is, the door can be opened.

Through the operation process described above, the door latch 100 of the present embodiment is capable of implementing an override function for deactivating (unlocking) the lock state and opening the door by only the operation of the inner handle.

The door latch 100 of the present embodiment as described above has the first contact end 151 and the second contact end 152 formed on the inner handle lever 150, so that the door lock state can be deactivated (unlocked) by interlocking with the first contact end 151 and the door can be opened by interlocking with the second contact end 152. The inner handle lever 150 is capable of reducing the number of lever components for implementing the override function and realizing the structure simplification by implementing the above two interlocking operations with a single lever component.

The door latch 100 of the present embodiment is configured such that the first contact end 151 first comes into contact with the inner link lever 160 and the second contact end 152 sequentially comes into contact the handle open lever 140, so that the deactivation (unlocking) of the door locking state and the opening operation of the door can be sequentially performed. Therefore, despite the structural simplification, it is possible to minimize the interference or malfunction of the lever components when the override function is executed.

The door latch 100 of the present embodiment includes the inner link lever 160 and the torsion spring 180 and is configured such that the rotational force of the inner handle lever 150 is transmitted to the inner lock lever 170 through the inner link lever 160 and the torsion spring 180. That is, the inner lock lever 170 is not directly interlocked with the inner handle lever 150 or the inner link lever 160, but receives a rotational force through a predetermined buffer means called a torsion spring 180. Therefore, even when the operation of the other operation button is simultaneously performed with the operation of the inner handle, or even if the lever components are not disposed at correct positions for a certain reason, the lever components can be prevented from being damaged through the buffering action of the torsion spring 180.

For example, it is assumed that the handle open lever 140 is rotated in the open direction (the clockwise direction in the drawings) in a state in which the link pin 211 is not inserted into and fastened to the link pin insertion groove 142 for a certain reason. In such a case, even if the inner lock lever 170 is rotated in the open direction (the counterclockwise direction in the drawings), the link pin 211 cannot be fastened to the link pin insertion groove 142. Thus, the rotation of the inner lock lever 170 may damage the link pin 211 or various components interlocked therewith. However, according to the present disclosure, since the rotation of the inner lock lever 170 is restricted by the torsion spring 180, it is possible to prevent breakage of the related components even in the above-described state. That is, even if the first contact end 151 of the handle open lever 140 pushes and rotates the inner link lever 160, the torsion spring 180 elastically deforms so as to receive the rotation of the inner link lever 160, and the inner lock lever 170 is not rotated. Therefore, it is possible to effectively prevent the breakage of lever components even if jamming occurs in various use environments.

While the embodiments of the present disclosure have been described, various modifications and changes can be made to the present disclosure by a person ordinarily skilled in the art by, for example, adding, changing, or deleting constituent elements without departing from the technical idea of the present disclosure defined in the claims, and the modifications and changes shall be deemed as falling within the scope of the present disclosure.

What is claimed is:

1. A vehicle door checker comprising:

an open lever configured to rotate a pawl in an open direction;

a handle open lever having a link pin insertion groove and configured to selectively cause the open lever to rotate;

an inner handle lever connected to an inner handle cable to be rotated in an open direction in response to operation of an inner handle, and comprising a first contact end and a second contact end configured to come into contact with the handle open lever while being rotated in the open direction so as to rotate the handle open lever in the open direction;

an inner link lever configured to come into contact with the first contact end when the inner handle lever is rotated in the open direction so as to be interlockingly rotated in an unlocking direction;

an inner lock lever configured to share a rotation axis with the inner link lever;

an elastic member fastened between the inner link lever and the inner lock lever so as to transmit a rotational force of the inner link lever in the unlocking direction to the inner lock lever; and a link comprising a link pin interlocked with rotation of the inner lock lever in the unlocking direction so as to be fastened to the link pin insertion grove.

2. The vehicle door checker of claim 1, wherein the elastic member includes a torsion spring having a first end portion fastened to the inner link lever and a second end portion fastened to the inner lock lever such that the inner link lever transmits the rotational force of the inner link lever in the unlocking direction to the inner lock lever.

3. The vehicle door checker of claim 1, wherein the inner lock lever is connected to a relay lever, which is provided to be interlocked with rotation of the inner lock lever in the unlocking direction so as to slide in the unlocking direction, and the link is fastened to the relay lever via a different rotation axis and rotates about the different rotation axis such that when the inner lock lever is rotated in the unlocking direction, the link pin is inserted into and fastened to the link pin insertion groove.

4. The vehicle door checker of claim 1, wherein, when the first contact end is in contact with the inner link lever when the inner handle lever is rotated in the open direction, the second contact end sequentially comes into contact with the handle open lever so as to rotate the handle open lever in the open direction.

5. The vehicle door checker of claim 1, wherein the link pin is provided to be disposed at:

a lock position at which the link pin is disengaged from the link pin insertion groove such that the open lever is not interlocked with the rotation of the handle opening lever in the open direction; and an unlock position at which the link pin is inserted into the link pin insertion groove such that when the handle open lever is rotated in the opening direction, the link pin is capable of coming into close contact with a link pin interlocking portion.

* * * * *